US006092684A

United States Patent [19]

Sato

[11] Patent Number: 6,092,684

[45] Date of Patent: Jul. 25, 2000

[54] CONNECTABLE CASES AND THE MANUFACTURING METHOD THEREOF

[75] Inventor: Hidekiyo Sato, Kyoto, Japan

[73] Assignee: Tanakaya, Inc., Kyoto, Japan

[21] Appl. No.: 08/896,958

[22] Filed: Jul. 18, 1997

[51] Int. Cl.[7] ..... B65D 21/024; B65D 25/00

[52] U.S. Cl. ..... 220/23.4; 206/504; 220/62; 220/676

[58] Field of Search ..... 220/23.4, 23.2, 220/23.6, 23.83, 62, 62.1, 23.86, 676; 206/504; 40/312; 229/102.5, 120.01, 165, 167, 168, 171, 174, 176, 181

[56] References Cited

U.S. PATENT DOCUMENTS

| | | | |
|---|---|---|---|
| 1,671,450 | 5/1928 | Ross | 220/23.2 |
| 2,634,020 | 4/1953 | Bartholomew | 40/312 |
| 3,409,193 | 11/1968 | Metcalf | 220/23.4 |
| 3,424,334 | 1/1969 | Goltz | 206/504 |
| 3,635,350 | 1/1972 | Wolf | 220/23.4 |
| 3,811,595 | 5/1974 | Eckdahl et al. | 220/23.4 |
| 3,857,482 | 12/1974 | Shelton | 220/23.4 |
| 3,918,781 | 11/1975 | Paris | 206/504 |
| 4,069,941 | 1/1978 | Popplewell, Jr. et al. | 220/23.4 |
| 4,079,852 | 3/1978 | Stoffregen | 220/62 |

*Primary Examiner*—Stephen Castellano
*Assistant Examiner*—Niki M. Eloshway
*Attorney, Agent, or Firm*—Jones, Tullar & Cooper, P.C.

[57] ABSTRACT

A connectable case and method of forming the connectable case from a synthetic resin plate. The case includes a bottom panel, four side-wall panels each extending from a respective side of the bottom panel and a flap panel extending from the side of at least one side-wall panel, the flap panel extending downwardly adjacent to its respective side-wall panel, such that the space between the downwardly extending flap panel and its respective side-wall panel is approximately equal to the thickness of a side-wall panel. One side-wall panel has at leat one hole formed therein, and one of the flap panel and its associated side-wall panel has at least one protrusion formed therein extend into the space.

1 Claim, 4 Drawing Sheets

CONNECTABLE CASES AND THE MANUFACTURING METHOD THEREOF

BACKGROUND OF THE INVENTION

1. Field of the Invention

The present invention relates to connectable cases which can be connected one by one and to a method of manufacturing such cases.

2. Prior Art

Conventionally, cases are connected side by side in such a way that a side-wall panel of a case is connected to a side-wall panel of another case with screws or screws and nuts; or that protrusions and holes are formed on side-walls of each case which are engaged to connect cases.

In general, such conventional cases require a complicated connection structure and high cost; also, the connection and disconnection of such cases is not easy. For cases connected with screws, for example, screws must be tightened or loosened each time cases are connected or disconnected; also, additional parts are required for connection/disconnection. For cases connected by engaging protrusions and holes, it is necessary to form such protrusions and holes, thereby increasing costs.

SUMMARY OF THE INVENTION

With the above-mentioned drawbacks in conventional methods in mind, an object of the present invention is to provide connectable cases which can be easily connected and disconnected at a low cost, and to a method of manufacturing thereof.

In order to attain the above-mentioned object, the connectable case is characterized in that the case consists of a bottom panel, four side-wall panels each extending from each of the four sides of the bottom panel, and a flap panel which extends from one of the four side-wall panels and extends down outside of the side-wall panel leaving a space approximately equivalent to the thickness of the side-wall panel between the flap panel and the side-wall panel; and the flap panel and/or the side-wall panel from which the flap panel extends have protrusions in the direction facing the other panel each; and the other side-wall panel which faces the side-wall panel with the flap panel has holes through which the above-mentioned protrusions on a side-wall panel and its flap panel of another case can be inserted.

In such cases, one of the side-wall panels and/or the flap panel extending therefrom have protrusions on them and the side-wall panel facing the side-wall panel with the flap panel has holes on it to correspond to the protrusions formed on the opposite side-wall panel. Thus, cases can be connected by inserting the holed side-wall panel of a case between the flap panel and the side-wall panel from which the flap panel extends and then having the protrusions extend into the corresponding holes. Cases can be disconnected by slightly strongly pulling the holed side-wall panel. Thus, cases can be easily connected and disconnected.

The protrusions are formed on a side-wall panel and the flap panel extending therefrom so that the protrusions on one of the panels face the other such panel; and they are not formed on the panel(s) by a separate process. Holes are made by punching in the manufacturing process and at the same time protrusions can be made by incomplete punching; namely, if punching is not complete, i.e., it is stopped in the middle of punching, the applicable sections of the panel are depressed on one side of the panel and protrudes on the other side of the panel. Thus, no additional production cost is needed.

The pair of connectable cases may be characterized in that one of the cases consists of a bottom panel, four side-wall panels each extending from each of the four sides of the bottom panel, with a pair of facing side-wall panels having a flap panel each which extends from each side-wall panel and extends down outside of side-wall panel leaving a space approximately equivalent to the thickness of the side-wall panel between the flap panel and the side-wall panel and each such flap panel and/or side-wall panel from which the flap panel extends having protrusions in the direction facing the other panel each; and the other case in the pair consists of a bottom panel and four side-wall panels each extending from each of the four sides of the bottom panel with a pair of facing side-wall panels having holes into which the above-mentioned protrusions on the other case can be inserted.

There are two kinds of cases. In one of them, a pair of side-wall panels facing each other have a flap panel each and protrusions are formed on each of the flap panels and/or the side-wall panels from which the flap panels extend. In the other, holes are made on a pair of side-wall panels facing each other. These two cases can be connected with the protrusions on one case inserted into the holes on the other case.

The method of manufacturing connectable cases of the present invention is characterized in that a configuration consisting of the bottom panel, four side-wall panels and the flap panel extending from one of the side-wall panels of the case above is cut from a synthetic resin plate; protrusions are formed at prescribed positions by way of incomplete punching on the side-wall panel with the flap panel; holes are made at prescribed positions by way of complete punching on the side-wall panel corresponding to the above-mentioned protrusions; then the cut configuration of synthetic resin plate is bent along the boarders between respective panels.

In this manufacturing method, the holes are made by complete punching and the protrusions are formed by incomplete punching when the entire configuration is cut from a synthetic resin plate. Incomplete punching means the punching is stopped in the middle of punching. By use of incomplete punching, protrusions can be easily formed as part of the case without requiring a complicated mold or additional cost.

DESCRIPTION OF THE PREFERRED EMBODIMENTS

Figure 1:
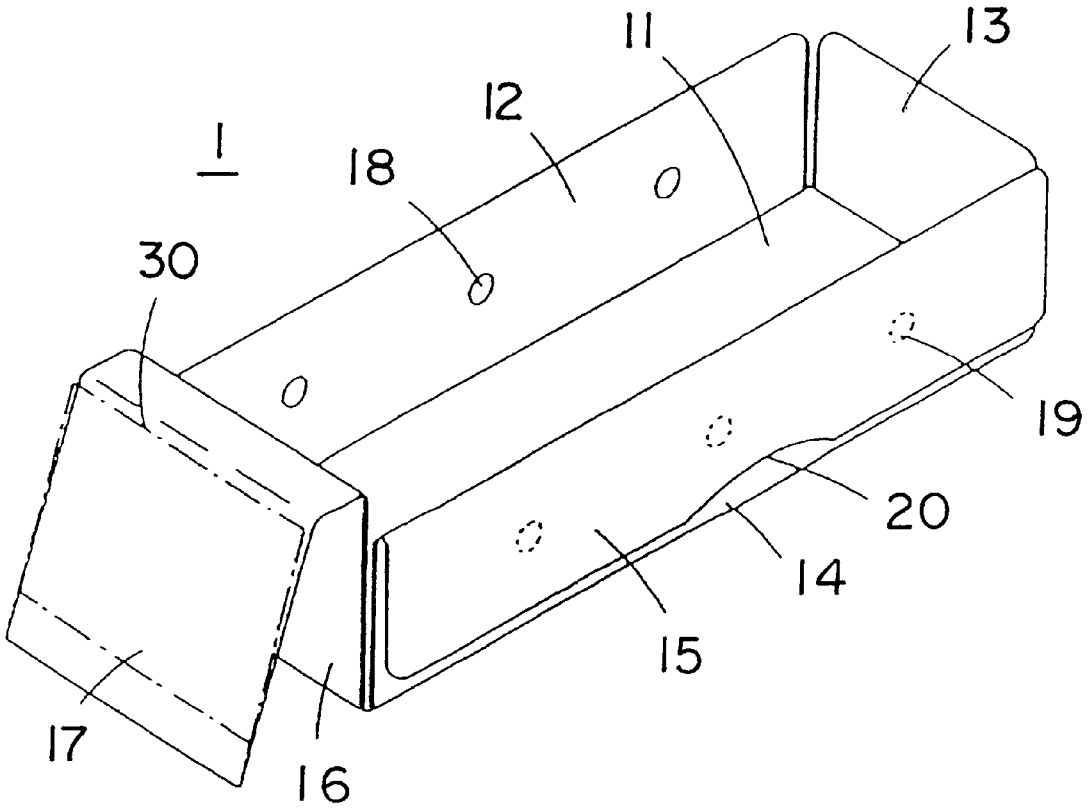
FIG. 1 is a left-side perspective view of a connectable case according to one embodiment of the present invention.

The present invention is explained below referring to a preferred embodiment. FIG. 1 shows a perspective view of a connectable case of a working example of the present invention. Case 1 consists of a rectangular bottom panel 11; side-wall panels 12, 13, 14 and 16 extending from the four sides of the bottom panel 11, respectively; a flap panel 15 extending from the side-wall panel 14 and flapping down outside of the side-wall panel 14 leaving a space approximately equivalent to the thickness of the side-wall panel 14 between the flap panel 15 and the side-wall panel 14; and a front flap panel 17 extending from the side-wall panel 16 located at one end of the side-wall panel 14 and flapping down outside the side-wall panel 16. The flap panel 15 has approximately the same height, direction and width as those of the side-wall panel 14. The side-wall panel 16 is slightly higher than the other side-wall panels 12, 13 and 14. There is an appropriate space between the front flap panel 17 and the side-wall panel 16.

In this embodiment, three cylindrical protrusions 19 are formed at equal intervals on the side-wall panel 14 and the flap panel 15 so that the protrusions on each panel face the protrusions on the other panel; and three holes 18 into which the protrusions are to be inserted are made on the side-wall panel 12 which faces the side-wall panel 14 at the same intervals corresponding to the protrusions 19. (See FIG. 4.) The shape of the protrusions 19 and the holes 18 may be any shape including circular, square, polygonal, triangular, etc. One protrusion and one hole are needed at least; however, it is better to have two each with an enough interval in order to connect cases stably.

In this embodiment, a circular arc 20 is cut off from the flap panel 15, so that cases can be connected and disconnected easily. The front flap panel 17 has a holder 30 for a name slip to be inserted. The holder 30 is made of a transparent material that is reasonably flexible and less thick than the material of the case 1. One end of the holder 30 is attached to the rear of the front flap panel 17 and the other end, as a free end, is located on the front side of the front flap panel 17 leaving a slight space into which a name slip describing the contents of the case will be inserted.

Figure 2:
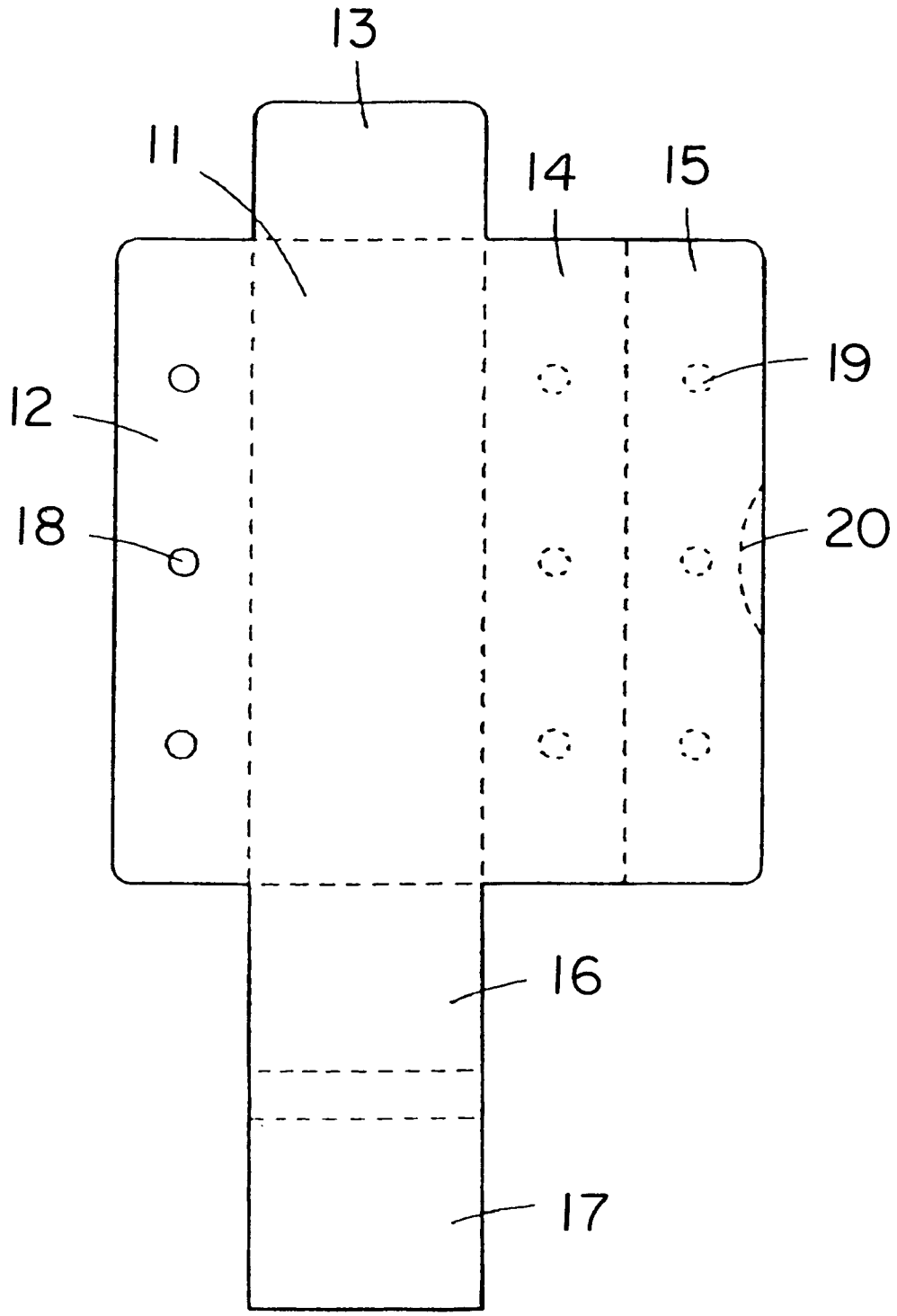
FIG. 2 is an open plan view of the case of FIG. 1.
Figure 4:
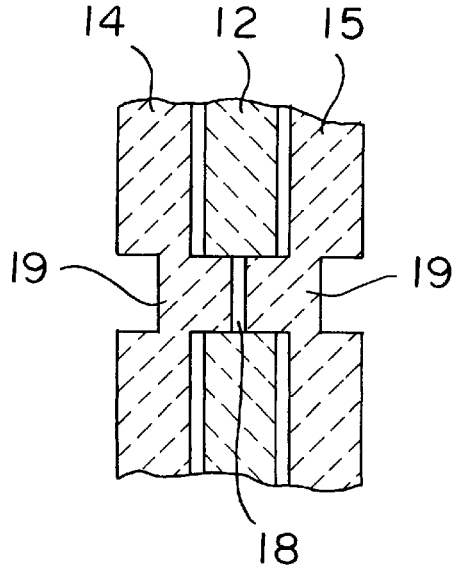
FIG. 4 is a cross sectional view showing the connection between two cases.

The case 1 can be made, for example, of a plastic plate (synthetic resin plate) of an appropriate flexibility. As shown in FIG. 2, the entire configuration of the case 1 is cut off from a plastic plate with the holes 18 punched at the section corresponding to the side-wall panel 12 and the protrusions 19 formed by incomplete punching on the sections corresponding to the side-wall panel 14 and the flap panel 15. Incomplete punching means that punching is stopped in the middle of punching. By use of incomplete punching, the protrusions 19 can be formed on the panels 14 and 15 as part of them as shown in FIG. 4. Also, the cut-off 20 is made. After obtaining the configuration as shown in FIG. 2, each section or panel is bent along the broken line (i.e., the border line between sections) so as to make the case 1. Thereafter the holder 30 is attached to the front flap panel 17 if necessary.

Figure 3:
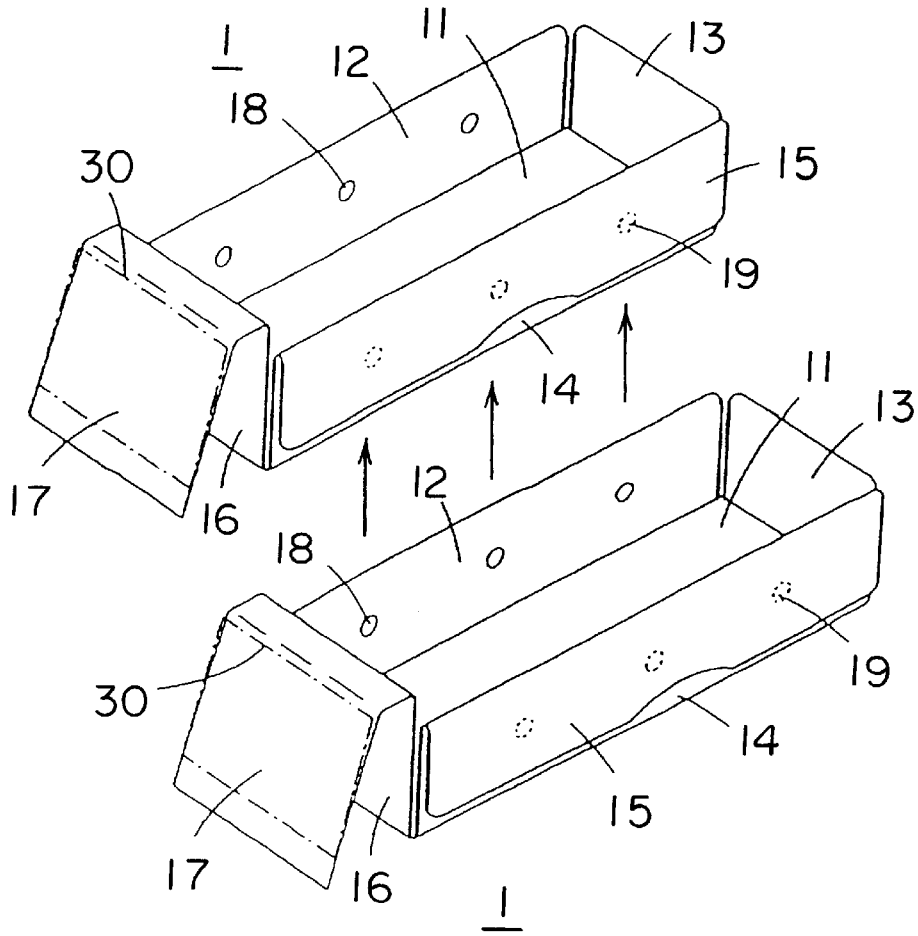
FIG. 3 is a view similar to FIG. 1 showing how two cases are connected.

To connect two cases 1 as shown in FIG. 3, the side-wall panel 12 of a case 1 is slightly strongly inserted into the space between the side-wall panel 14 and the flap panel 15 of the other case 1. The side-wall panel 12 can be relatively easily inserted into the space by slightly pushing the flap panel 15 outward by the side-wall panel 12. When the side-wall panel 12 is inserted, as shown in FIG. 4, the protrusions 19 on the side-wall panel 14 and the protrusions 19 on the flap panel 15 are inserted into the holes 18 on the side-wall panel 12 from both sides of the panel 12 respectively so that the side-wall panel 12 is supported by the protrusions 19, thereby the side-wall panel 12 will not come off easily from the space. Also, the case 1 whose side-wall panel 12 is inserted can be stably connected to the other case because the side-wall panel 12 is held at its both sides by the side-wall panel 14 and the flap panel 15 of the other case. More than two cases can be connected one by one in the same manner.

A case 1 can be disconnected from another case 1 by strongly pulling the side-wall panel 12 of the case 1. The side-wall panel 12 can be easily pulled out by slightly pushing the flap panel 15 of the other case 1 outward.

Figure 5:
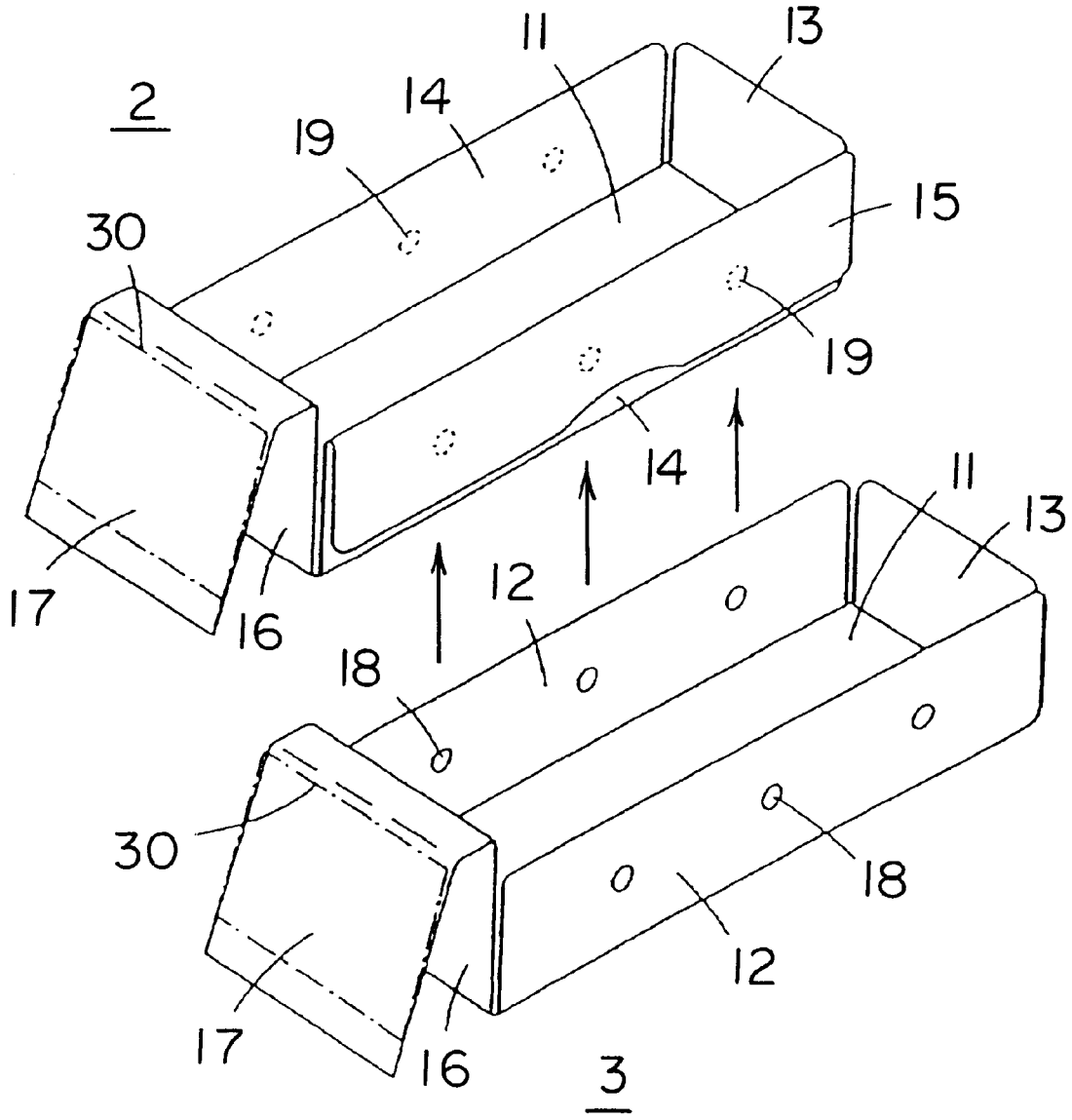
FIG. 5 is a view similar to FIG. 3 but with an altered arrangement of holes and protrusions.

The above embodiment is only one example of many that are conceivable. In FIG. 5, for example, the two facing side-wall panels 14 and their flap panels 15 of the case 2 have protrusions respectively and the two facing side-wall panels 12 of the case 3 have holes 18. In this example, a case 2 is connected to a case 3 which then is connected to another case 2 and then case 3, and so on. Cases 2 and cases 3 can be manufactured in a similar manner mentioned above.

In the above-mentioned embodiment, the protrusions 19 on the panel 14 and those on the flap panel 15 are formed so as to face each other; however, they can be arranged to be displaced from each other and also they can be formed on either the side-wall panel 14 or the flap panel 15 only; however, the holes 18 need to be made on the corresponding side-wall panel 12.

The above-mentioned examples of the noted embodiment, it is clear that cases of the same size and configuration can be connected; however, cases of different sizes and configurations can also be connected. Namely, the present invention provides a means of connecting cases relatively freely regardless of their sizes and shapes. Also, cases may be transparent so that the contents of the cases can be seen from the outside, or the cases may be colored.

As explained above, the connectable cases can be connected by inserting a case's holed side-wall panel into the space between the flap panel and the side-wall panel from which the flap panel of another case extends, so as to have the protrusions and the holes engage. Cases can be disconnected by slightly strongly pulling the holed side-wall panel from the space. Thus, cases can be easily connected and disconnected.

Protrusions can be made by stopping the punching process in the middle, thereby requiring no additional cost.

Cases of the present invention are very convenient in that cases of different sizes and shapes can be relatively easily connected in a simple manner.

According to the method of manufacturing connectable cases according to the present invention, the holes are made by means of punching and the protrusions are formed by means of incomplete punching when the entire case configuration is cut off from a synthetic resin plate. Incomplete punching is a punching that is stopped in the middle of the punching operation and thus makes it possible that the protrusions are formed as part of the panel. Thus, no complicated molds or additional cost are required, so that cases can be manufactured easily.

I claim:

1. A pair of connectable cases, each comprising a bottom panel, four side-wall panels each extending from a respective side of said bottom panel, and a flap panel extending from the side of one side-wall panel, said flap panel extending downwardly adjacent to its respective side-wall panel such that the space between said downwardly extending flap panel and its respective side-wall panel is approximately equal to the thickness of a side-wall panel, wherein one side-wall panel has a plurality of holes formed therein, and one of said flap panel and its associated side-wall panel has an equal plurality of protrusions formed thereon which extend into said space, and wherein the side-wall panel of one case is received in said space defined by the other case where said plurality of holes are engaged by said plurality of protrusions, so that when the two cases are connected each protrusion engages a respective hole.

* * * * *